US008506459B2

(12) United States Patent
Cassidy et al.

(10) Patent No.: US 8,506,459 B2
(45) Date of Patent: Aug. 13, 2013

(54) FREESTANDING EXERCISE APPARATUS

(75) Inventors: John M. Cassidy, Otsego, MN (US); Michael G. Novak, Ham Lake, MN (US); Nathan R. Luger, Roseville, MN (US)

(73) Assignee: Torque Fitness, LLC, Andover, MN (US)

( * ) Notice: Subject to any disclaimer, the term of this patent is extended or adjusted under 35 U.S.C. 154(b) by 1378 days.

(21) Appl. No.: 11/831,265

(22) Filed: Jul. 31, 2007

(65) Prior Publication Data

US 2009/0181833 A1 Jul. 16, 2009

Related U.S. Application Data

(60) Provisional application No. 60/820,975, filed on Aug. 1, 2006.

(51) Int. Cl.

| | |
|---|---|
| ***A63B 21/06*** | (2006.01) |
| ***A63B 21/062*** | (2006.01) |
| ***A63B 21/00*** | (2006.01) |

(52) U.S. Cl.
USPC ..... 482/94; 482/102; 482/103; 482/138

(58) Field of Classification Search
USPC ..... 482/97–103, 133, 135–138, 910, 482/92–94, 904
See application file for complete search history.

(56) References Cited

U.S. PATENT DOCUMENTS

| | | | | |
|---|---|---|---|---|
| 332,989 | A | 12/1885 | Benedict | |
| 2,632,645 | A | 3/1953 | Barkschat | |
| 3,874,657 | A * | 4/1975 | Niebojewski | 482/104 |
| 4,431,181 | A | 2/1984 | Baswell | |
| 4,898,381 | A * | 2/1990 | Gordon | 482/103 |
| 5,718,657 | A | 2/1998 | Dalebout et al. | |
| 5,718,658 | A | 2/1998 | Miller et al. | |
| 5,725,459 | A * | 3/1998 | Rexach | 482/92 |
| 6,247,272 | B1 | 6/2001 | Shipman | |
| 6,443,877 | B1 * | 9/2002 | Hoecht et al. | 482/103 |
| 6,447,430 | B1 * | 9/2002 | Webb et al. | 482/98 |
| 6,685,601 | B1 * | 2/2004 | Knapp | 482/104 |
| 6,689,023 | B2 | 2/2004 | Baumler | |
| 8,075,454 | B2 * | 12/2011 | Piggins | 482/62 |
| 8,210,995 | B2 * | 7/2012 | Reyes | 482/98 |
| 2002/0091043 | A1 * | 7/2002 | Rexach | 482/98 |

* cited by examiner

*Primary Examiner* — Oren Ginsberg
(74) *Attorney, Agent, or Firm* — Sherrill Law Offices, PLLC

(57) ABSTRACT

A freestanding exercise apparatus comprises a frame, a right door, a left door, and an exercise resistance source. The frame defines a sagittal plane dividing the frame into a left half and a right half with anterior and posterior ends. The right door is pivotally attached to the right half of the frame proximate the anterior end of the frame for pivoting about a right pivot axis. The left door is pivotally attached to the left half of the frame proximate the anterior end of the frame for pivoting about a left pivot axis. The exercise resistance source is connected to the frame. The frame, right pivot axis, and left pivot axis are configured and arranged such that the angle formed at the intersection of a first plane defined by the right pivot axis and the posterior end of the right half of the frame and a second plane defined by the left pivot axis and the posterior end of the left half of the frame is less than 90°.

19 Claims, 11 Drawing Sheets

FREESTANDING EXERCISE APPARATUS

This application claims the benefit of U.S. Provisional Application No. 60/820,975, filed Aug. 1, 2006.

BACKGROUND

Strength training is becoming a popular area of exercise as more people change to healthier lifestyles. In the past, to accomplish strength training for multiple areas of the body often required the use of several different exercise machines. The need to utilize several different exercise machines often limited availability of strength training machines to gyms due to the cost of the various machines and the space needed to house the machines. People wanting to take advantage of the health benefits of strength training for multiple areas of the body normally had to join a gym. Using equipment at a gym requires exercising in public and at the hours dictated by the gym and use of the machines by others.

Multi-purpose gym systems such as that disclosed in U.S. Pat. No. 6,689,023 were developed to allow people to perform strength training exercise in the privacy of their own homes. The multi-purpose gym allows multiple strength training exercises with one machine, significantly reducing the amount of space needed in a home to accommodate the equipment. But the multi-purpose gym systems are still large and heavy. The size and weight of the systems discourage the average user from moving the system around the home if space needs change. The same problems have occurred in regard to exercise treadmills. Many people want treadmills in their home for convenience but are then left with an unsightly piece of equipment in their home that is also a potential for injury to children and pets when not in use.

Storing exercise equipment in a cabinet is well-known as a way to improve the aesthetic appearance and space needed when not in use and to protect children and pets. U.S. Pat. No. 5,718,657 discloses a treadmill that pivots into a cabinet. U.S. Pat. No. 332,989 also discloses a cabinet with a hinged door to conceal exercise equipment. The disadvantages with the cabinets disclosed is that they are all made to sit next to a vertical wall and take up considerable floor space when in use and even when not in use because of the required positioning to accommodate the equipment.

Therefore, what is needed is a multi-use exercise apparatus that may be enclosed to conceal the exercise equipment and reduce the likelihood of injury to children and pets when not in use and to take up a minimal amount of usable floor space when in use as well as when it is being stored.

SUMMARY OF THE INVENTION

A first embodiment of the invention is a freestanding exercise apparatus comprising a frame, a right door, a left door, and an exercise resistance source. The frame defines a sagittal plane dividing the frame into a left half and a right half with anterior and posterior ends. The right door is pivotally attached to the right half of the frame proximate the anterior end of the frame for pivoting about a right pivot axis. The left door is pivotally attached to the left half of the frame proximate the anterior end of the frame for pivoting about a left pivot axis. The exercise resistance source is connected to the frame. The frame, right pivot axis, and left pivot axis are configured and arranged such that the angle formed at the intersection of a first plane defined by the right pivot axis and the posterior end of the right half of the frame and a second plane defined by the left pivot axis and the posterior end of the left half of the frame is less than 90°.

A second embodiment of the invention is a freestanding exercise apparatus comprising a frame, an exercise resistance source, a right door pivotably attached to the frame, a left door pivotably attached to the frame, a first exercise unit attached to the right door, and a second exercise unit attached to the left door. The exercise resistance source is connected to the frame. The first exercise unit reciprocates along a path relative to the right door and is configured and arranged to pivot with the right door relative to the frame. The first exercise unit is operably connected to the exercise resistance source wherein the source provides resistance to the reciprocating exercise unit. The second exercise unit reciprocates along a path relative to the left door and is configured and arranged to pivot with the left door relative to the frame. The second exercise unit is operably connected to the exercise resistance source wherein the source provides resistance to the reciprocating exercise unit.

DETAILED DESCRIPTION OF A PREFERRED EMBODIMENT

Nomenclature

| | |
|---|---|
| 10 | Exercise apparatus |
| 20 | Frame |
| 21 | Sagittal plane |
| 22 | Right half |
| 22a | Anterior end |
| 22b | Posterior end |
| 23 | Left half |
| 23a | Anterior end |
| 23b | Posterior end |
| 24 | Top member |
| 25 | Bottom member |
| 30 | Exercise resistance source |
| 40 | Angle |
| 50 | Platform |
| 51 | Seat |
| 52 | Support |
| 60 | Right door |
| 61 | Door frame |

-continued

| | |
|---|---|
| 62 | Outer housing |
| 63 | Space |
| 64 | Right pivot axis |
| 70 | Left door |
| 71 | Door frame |
| 72 | Outer housing |
| 73 | Space |
| 74 | Left pivot axis |
| 80 | Attachment mechanism |
| 81 | Cable guides |
| 82 | Cable |
| 90 | Platform space |
| 100 | First exercise unit |
| 110 | Second exercise unit |
| 120 | First plane |
| 130 | Second plane |
| 200 | Wall |
| α | Door angle |

Construction

Figure 3:
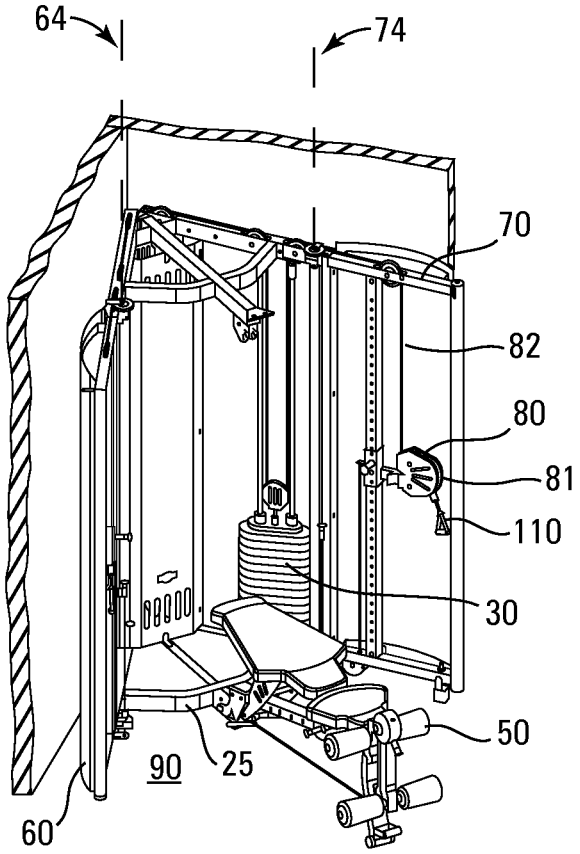
FIG. 3 is a front perspective view of the apparatus in FIG. 1 with the doors locked in the second open position and the platform in the use position.

As shown in FIG. 3 one embodiment of the freestanding exercise apparatus 10 comprises a frame 20, a right door 60, a left door 70, and an exercise resistance source 30. The frame 20 may be made from any suitable materials such as wood, plastic, and metal. The preferred material is metal.

Figure 2:
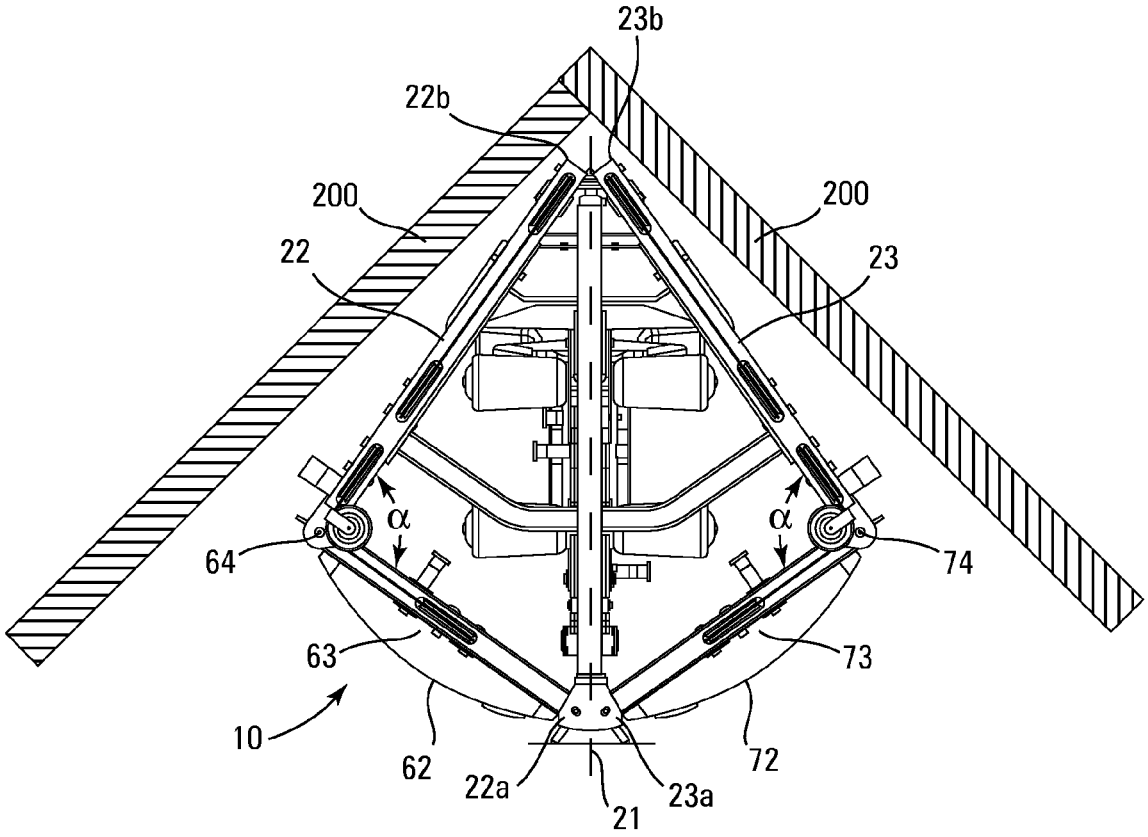
FIG. 2 is a top view of the apparatus in FIG. 1.

As shown in FIG. 2, the frame 20 defines a sagittal plane 21 dividing the frame 20 into a left half 23 and a right half 22 with anterior ends 22*a*, 23*a* and posterior ends 22*b*, 23*b*. Proximate the anterior end 22*a* of the right half 22 of the frame 20 a right door 60 is pivotally attached to the right half 22 of the frame 20 for pivoting about a right pivot axis 64. Proximate the anterior end 23*a* of the left half 23 of the frame 20 a left door 70 is pivotally attached to the left half 23 of the frame 20 for pivoting about a left pivot axis 74. The frame 20, right pivot axis 64 and left pivot axis 74 are configured and arranged such that an angle 40 is formed at the intersection of a first plane 120 and a second plane 130. The first plane 120 is defined as the right pivot axis 64 and the posterior end 22*b* of the right half 22 of the frame 20. The second plane 130 is defined as the left pivot axis 74 and the posterior end 23*b* of the left half 23 of the frame 20.

As shown in FIG. 2, preferably the angle 40 is less than 90° and greater than 50°. The most preferred angle 40 is 70°. An angle 40 less than 90° may allow the apparatus 10 to be placed in a corner of a room even when the walls 200 of the room do not form a true 90° angle 40. A smaller angle 40 may make the profile of the exercise apparatus 10 appear smaller to the user when not in use.

Figure 1:
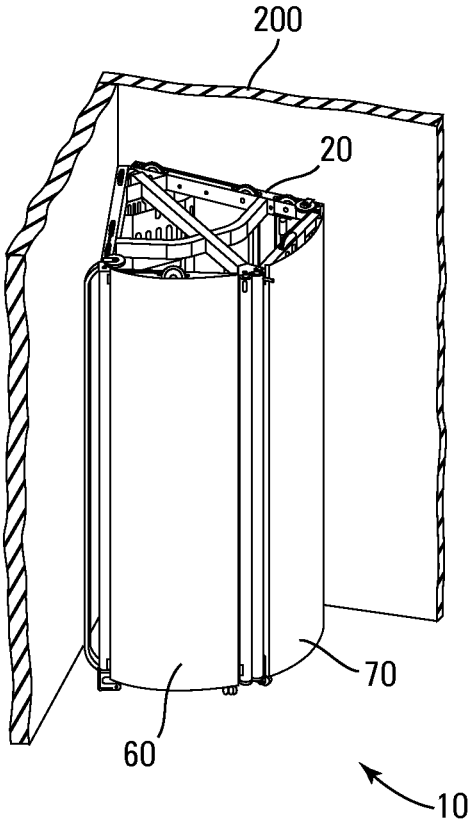
FIG. 1 is a front perspective view of one embodiment of the freestanding exercise apparatus with the doors in a closed position.

As shown in FIGS. 1 and 3, the right door 60 is pivotably attached to the right half 22 of the frame 20 for pivoting about the right pivot axis 64. The left door 70 is pivotably attached to the left half 23 of the frame 20 for pivoting about the left pivot axis 74. Preferably the right door 60 and the left door 70 may be pivoted between a closed position, a first open position, and a second open position. The right door 60 and left door 70 may also be locked in the first position or the second position.

As shown in FIG. 2, preferably the right door 60 in the closed position is configured and arranged to be at proximately a 90° door angle α relative to the first plane 120. The first open position may be at a door angle α of between 90° and 160° relative to the first plane 120. Preferably the first open position is at a door angle α of about 157° relative to the first plane 120. The second open position may be at a door angle α of between 160° and 190° relative to the first plane 120. Preferably the second open position is at a door angle α of about 180° relative to the first plane 120.

The left door 70 in the closed position is configured and arranged to be at proximately a 90° door angle α relative to the second plane 130. The first open position may be at a door angle α of between 90° and 160° relative to the second plane 130. Preferably the first open position is at a door angle α of about 157° relative to the second plane 130. The second open position may be at a door angle α of between 160° and 190° relative to the second plane 130. Preferably the second open position is at a door angle α of about 180° relative to the second plane 130.

Figure 5:
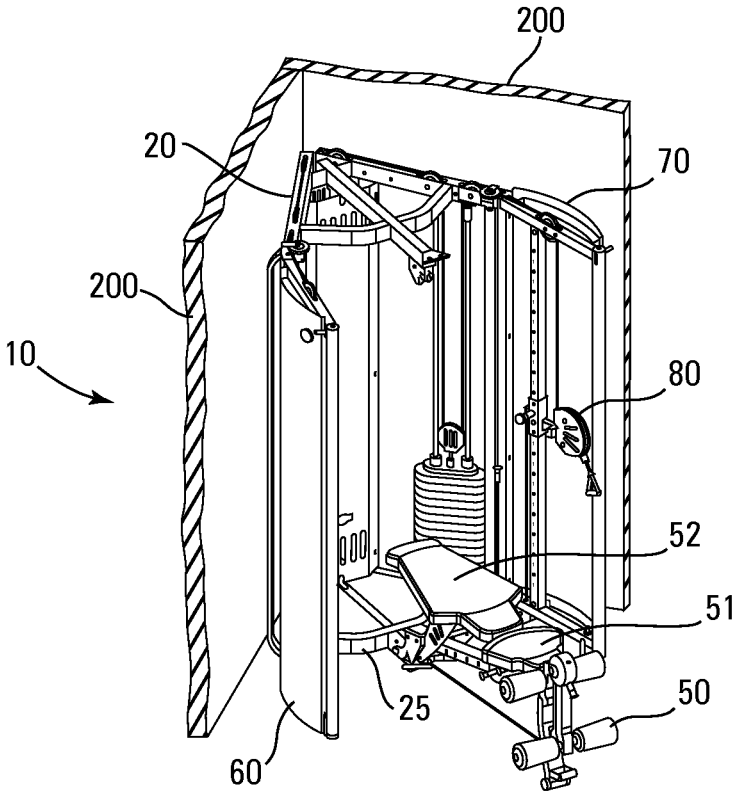
FIG. 5 is a front perspective view of the apparatus in FIG. 1 with the doors locked in the first open position and the platform in the use position.
Figure 6:
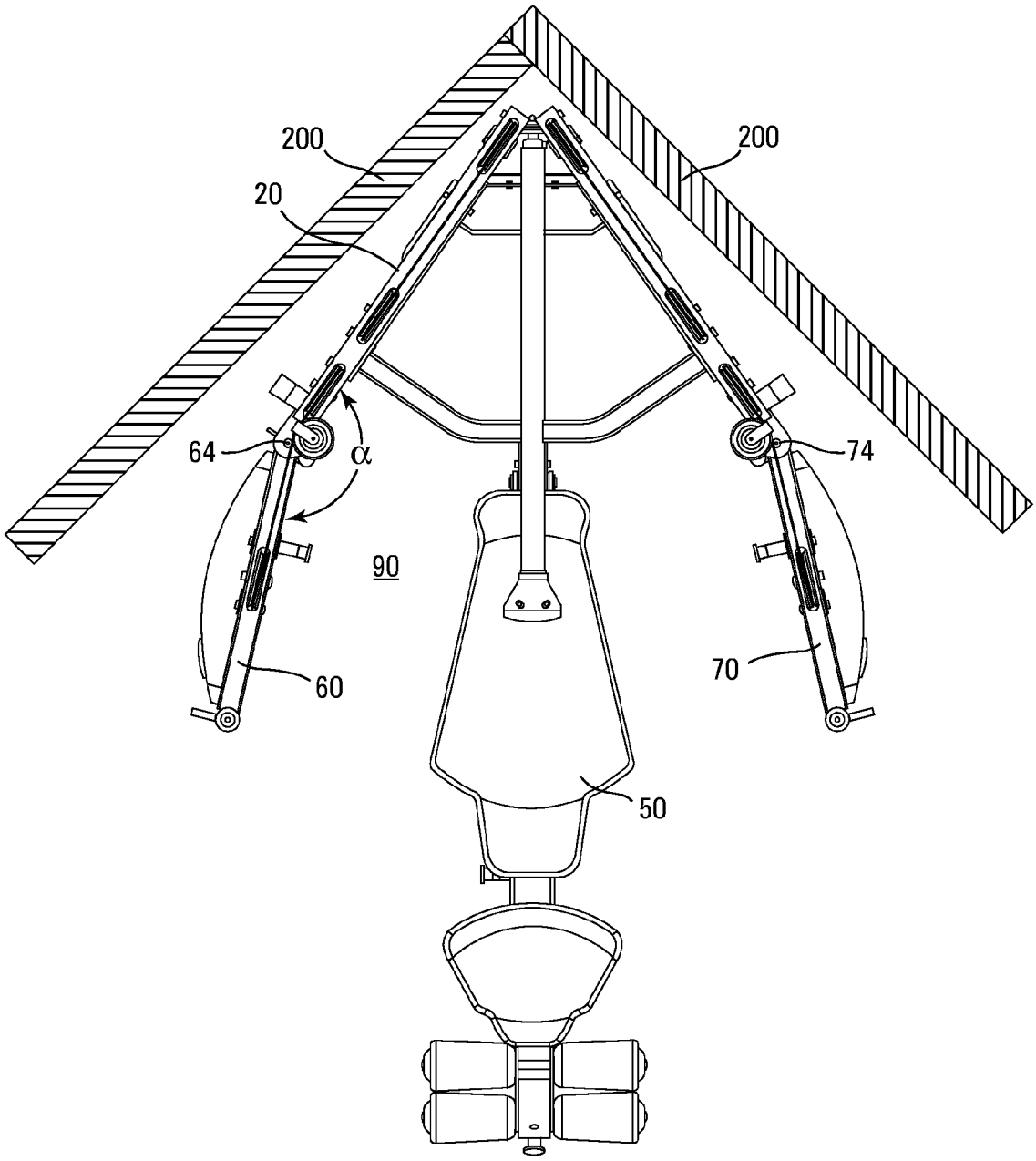
FIG. 6 is a top view of the apparatus in FIG. 5.

As shown in FIGS. 3 and 5, the apparatus 10 may also have an exercise resistance source 30 connected to the frame 20. The exercise resistance source 30 may be any suitable resistance providing mechanism such as leaf springs, pistons, hydraulic cylinder, pneumatic cylinder, a brake mechanism, elastic bands, springs, or a weight stack. The most preferred exercise resistance source 30 is a weight stack. Weight stacks for exercise apparatuses 10 are well known in the industry. The preferred weight stack is a 200 pound weight stack with sound dampening bushings to prevent metal-on-metal contact and solid steel guide rods. The solid steel guide rods may create smooth, quiet weight stack travel. The weight stack may be configured and arranged to connect to the left half 23 of the frame 20 or the right half 22 of the frame 20.

Figure 4:
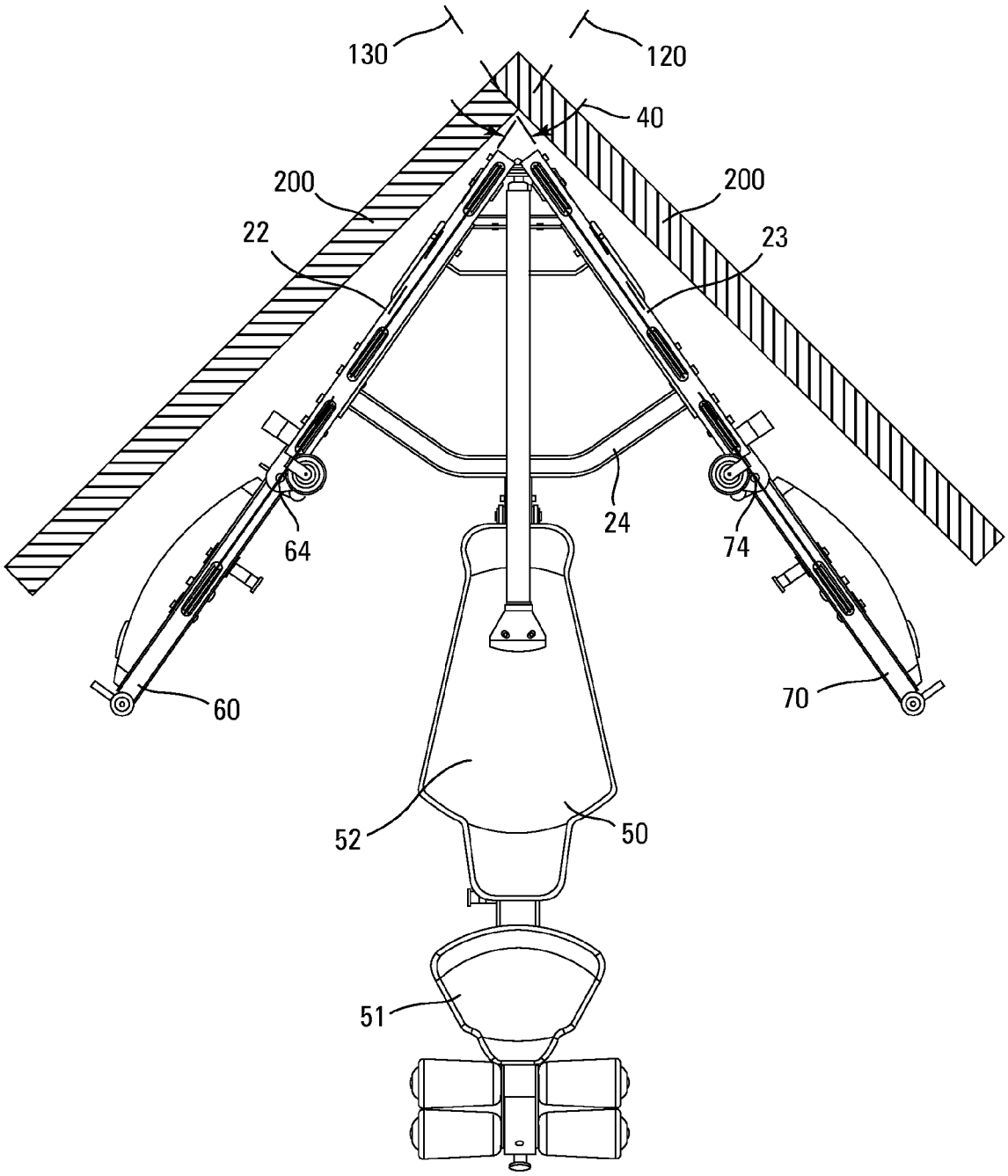
FIG. 4 is a top view of the apparatus in FIG. 3.

As shown in FIGS. 3 and 4, the exercise apparatus 10 may also have a platform 50 pivotably attached to the frame 20. Preferably the platform 50 pivots from a bottom member 25 of the frame 20. The platform 50 is preferably an integrated horizontal bench for performing traditional seated exercises such as chest presses, lat pull downs, and shoulder presses. The platform 50 may be pivoted into a use position in the platform space 90 in which the platform 50 provides a substantially horizontal surface relative to the ground in which the user may sit to perform exercises. The platform 50 may include a padded seat 51 to provide comfort to the user. Preferably the seat 51 is pivotably attached to the platform 50 to allow the seat 51 to be inclined or declined. The platform 50 may also include a support 52 that may be adjusted, when the platform 50 is in the use position, from an angle (not numbered) of 0° to 75° relative to the platform 50 to accommodate various exercises. Preferably the support 52 is configured and arranged to be adjustable between and set at a 0°, 30°, 45°, 60°, or 75° angle (not numbered) relative to the floor (unnumbered).

Figure 7:
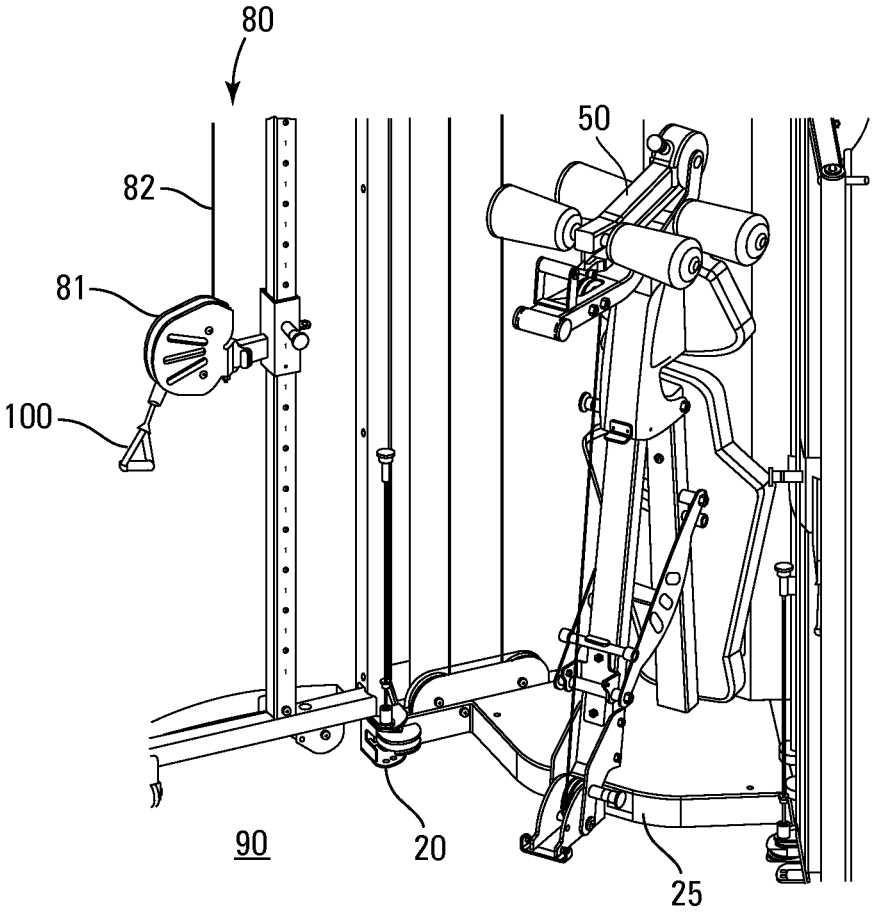
FIG. 7 is a partial front perspective view of the apparatus in FIG. 1 with the doors locked in the second open position and the platform in the stored position.

As shown in FIG. 7, the platform 50 may then be pivoted into a stored position such that the platform 50 is moved so that the platform 50 is no longer in a horizontal position, is no longer in the platform space 90, and does not interfere with use of other aspects of the apparatus 10. Pivoting the platform 50 into the stored position opens the platform space 90 for standing exercises such as lunges or movements that utilize a stability ball. Preferably the platform 50 may be locked in the stored position to prevent the platform 50 from interfering with use of the rest of the exercise apparatus 10. The platform 50 may also include a seated leg extension, and a prone leg curl station.

Figure 8:
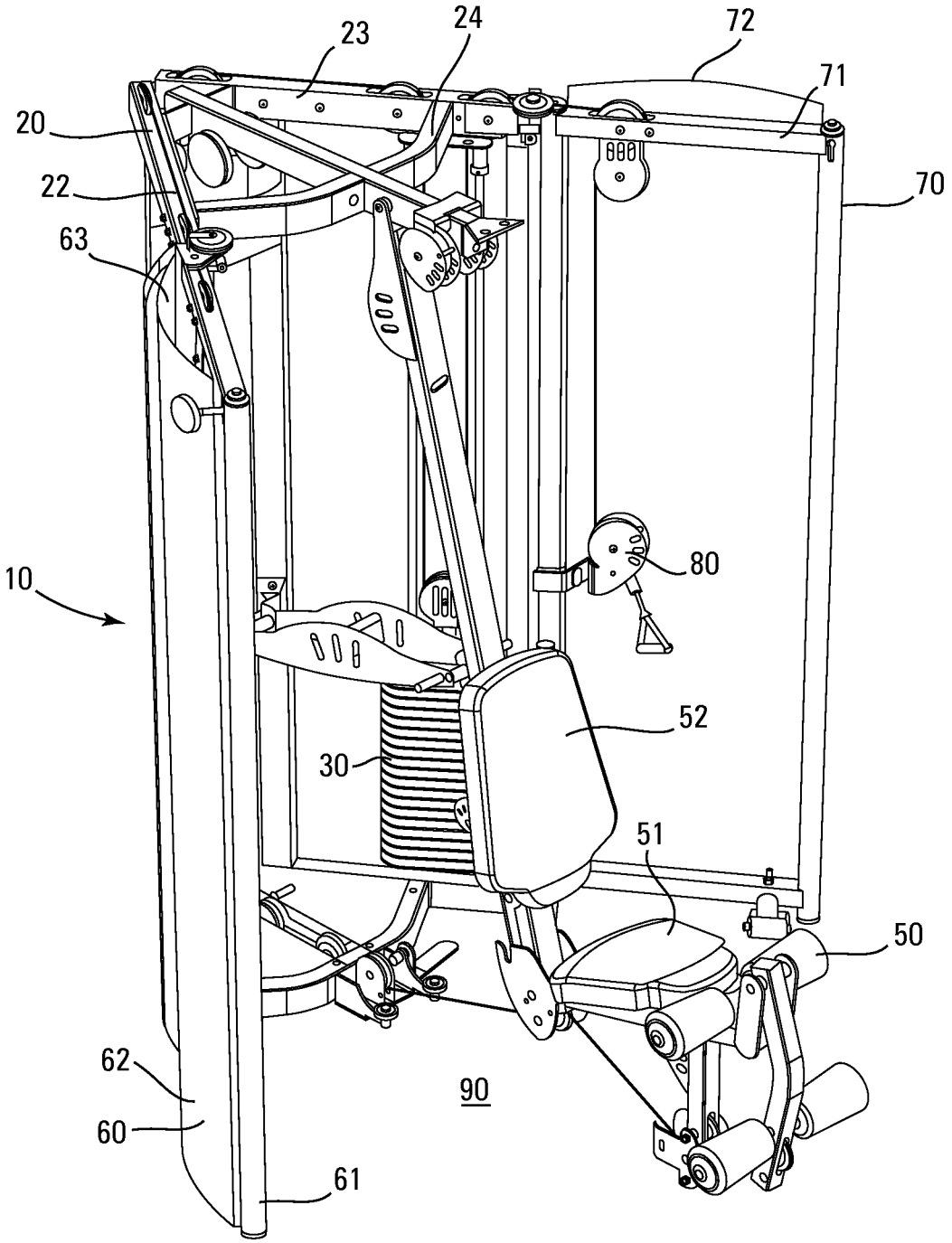
FIG. 8 is a front perspective view of a second embodiment of the freestanding exercise apparatus with the doors locked in the second open position and the platform in the use position.
Figure 9:
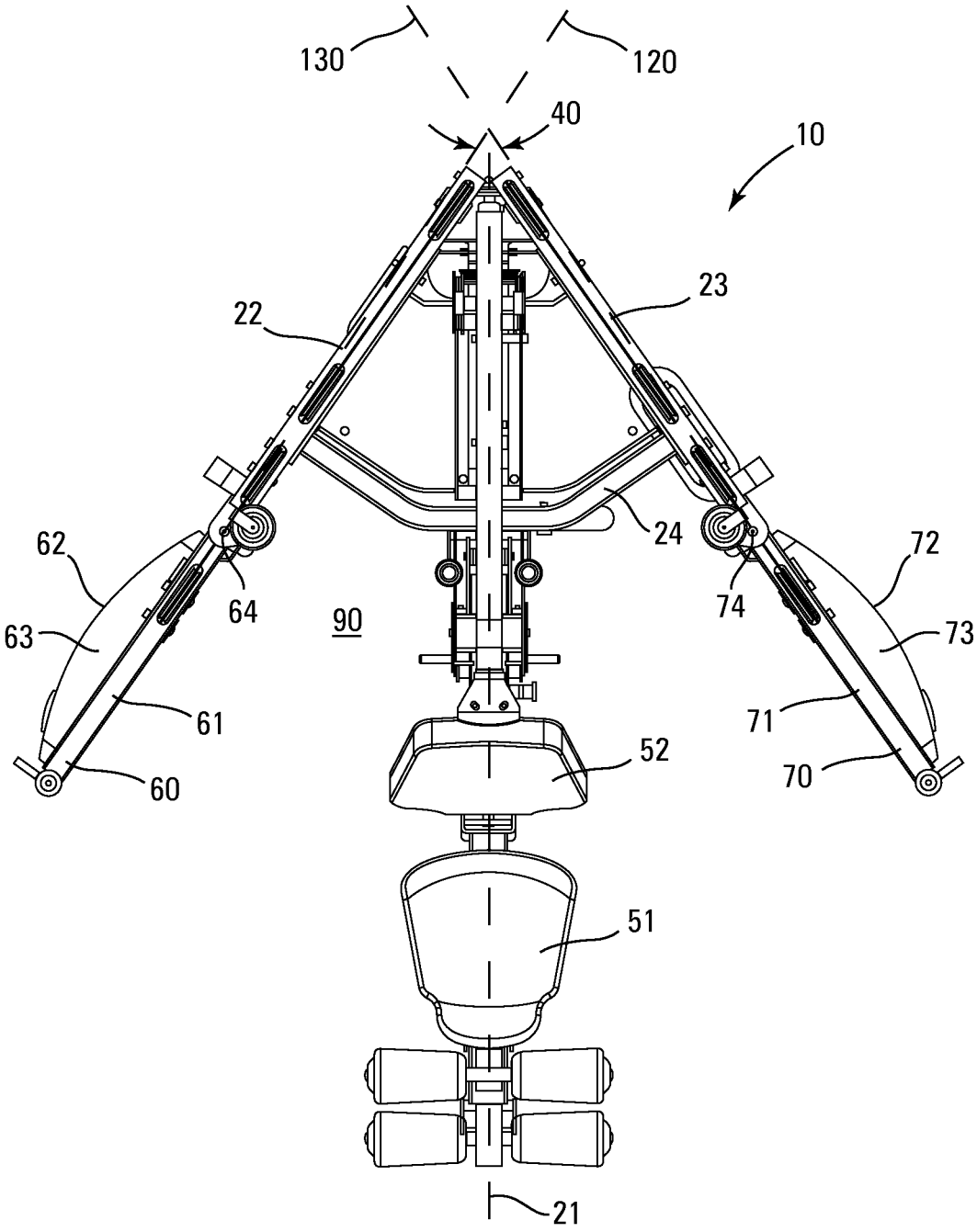
FIG. 9 is a top view of the exercise apparatus in FIG. 8.

As shown in FIGS. 8 and 9, the platform 50 may be pivotably attached to a top member 24 of the frame 20. The platform 50 may be pivoted into a use position in the platform space 90. The platform 50 in the use position may provide a seat 51 upon which the user (not shown) may sit to perform exercises. The platform 50 may also include a support 52 that may be adjusted, when the platform 50 is in the use position, preferably from an angle (not numbered) of 90° to 60° relative to the seat 51 to accommodate various exercises. The platform 50 may also include a seated leg extension, standing leg curl station, and ankle strap for hip abduction and extension.

Figure 10:
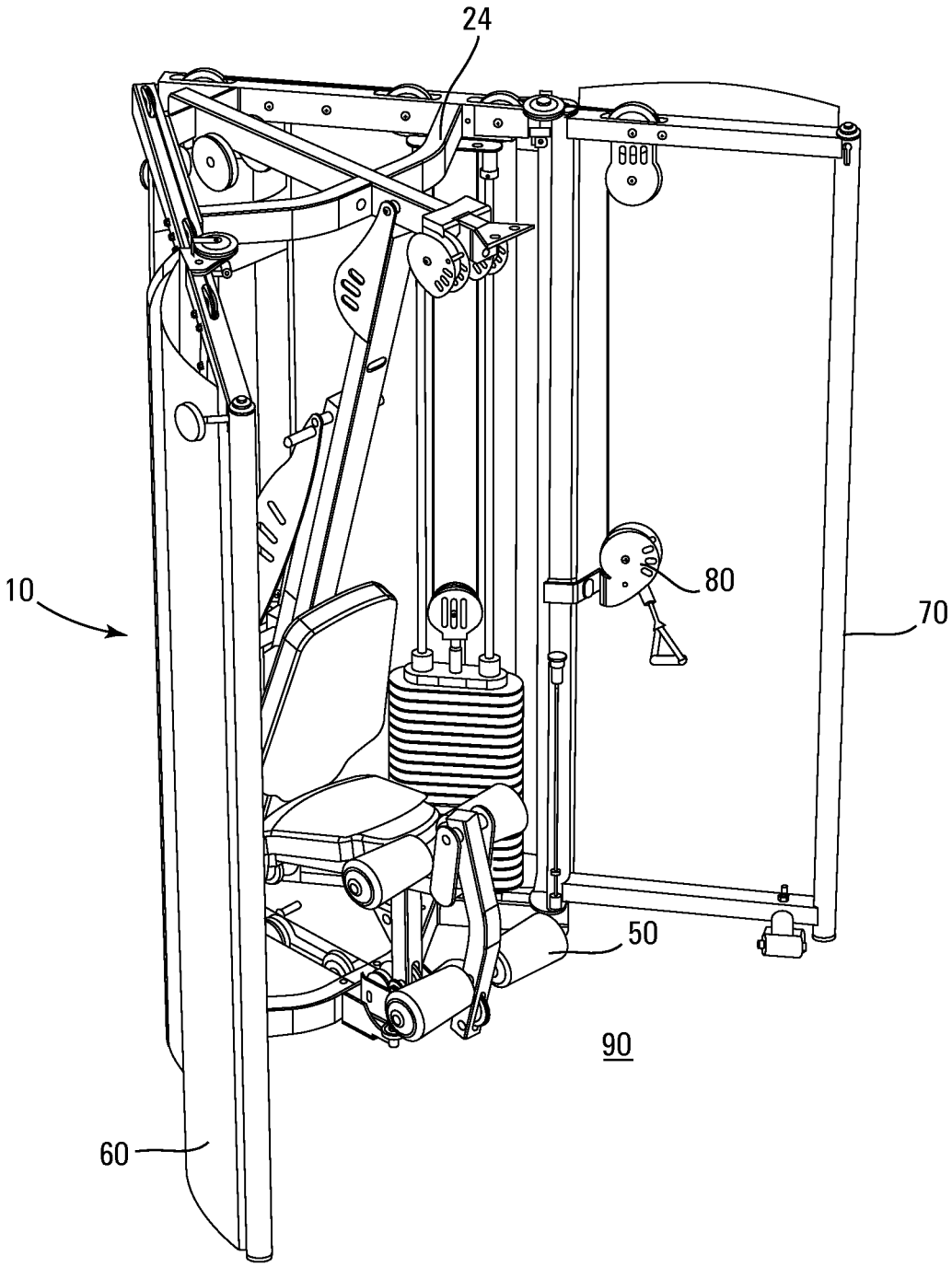
FIG. 10 is a front perspective view of the apparatus in FIG. 8 with the platform in the stored position.
Figure 11:
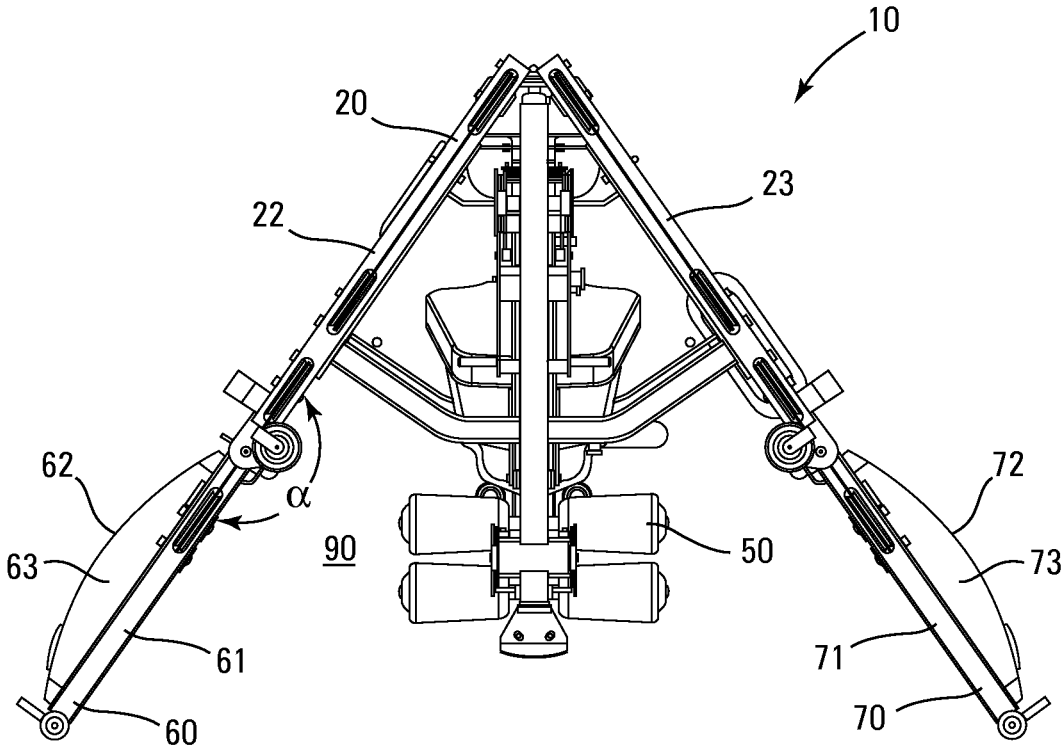
FIG. 11 is a top view of the apparatus in FIG. 10.

As shown in FIGS. 10 and 11, the platform 50 may then be pivoted into a stored position such that the platform 50 is moved so that the platform 50 is no longer in the platform space 90. Preferably the platform 50 may be locked in the stored position to prevent the platform 50 from interfering with use of the rest of the exercise apparatus 10.

The right door 60 may have a frame 61 and an outer housing 62 as shown in FIG. 2. Preferably the outer housing 62 is configured and arranged to define a space 63 between the housing 62 and the frame 61. As shown in FIG. 2, preferably the outer housing 62 has a curvilinear plan shape. The right door 60 and the left door 70 may have a latch (not shown) to keep the doors 60, 70 in the closed position.

The left door 70 may have a frame 71 and an outer housing 72. Preferably the outer housing 72 is configured and arranged to define a space 73 between the housing 72 and the frame 71. As shown in FIG. 2, preferably the outer housing 72 has a curvilinear plan shape.

As shown in FIG. 7, the apparatus 10 may have a first exercise unit 100 attached to the right door 60. The first exercise unit 100 may be any piece of exercise attachment equipment such as a tricep strap, a grip handle, a tricep press down V bar, stirrup handle, chinning triangle, straight bar, double stirrup handle, curl bar, tricep rope, straight lat bar, head harness, single cable handle, lat pull down bar, ankle cuff, foot cuff, or shoulder cuff. The first exercise unit 100 may be attached to the right door 60 such that the first exercise unit 100 reciprocates along a path relative to the right door 60 and is configured and arranged to pivot with the right door 60 relative to the frame 20. Preferably the first exercise unit 100 is attached to the door 60 by an attachment mechanism 80. The most preferred attachment mechanism 80 is a cable pulley system. The cable pulley system may have a plurality of cable guides 81 and cables 82 in communication with the exercise unit 100 and the exercise resistance source 30.

The right door 60 may have a cable guide 81 attached to its frame 61. The cable guide 81 may be fixedly attached or moveable attached to the door frame 61. Preferably, as shown in FIG. 7, the cable guide 81 is a pulley that is configured and arranged to be adjustable in two degrees of freedom. Preferably, the cable guide 81 may be repositionable along the height (not numbered) of the door 60. The cable guide 81 may also be repositionable in a horizontal plane away from the frame 61 of the door 60. Most preferably the cable guide 81 is repositionable in the horizontal plan proximately 120°.

As shown in FIG. 3, the apparatus 10 may also have a second exercise unit 110 attached to the left door 70. The second exercise unit 110 may be attached to the left door 70 in a similar manner as described above for the right door 60.

Use

Preferably the exercise apparatus 10 is placed in a corner formed by two walls 200 as shown in FIGS. 1 and 2. Placement in a corner formed by two walls 200 may reduce the floor space needed to store and use the apparatus 10. Use of the exercise apparatus 10 is initiated by unlatching the right door 60 and the left door 70. The right door 60 and the left door 70 may then be pivoted into the first open position or the second open position and locked depending on the type of exercise to be performed. One or more exercise units 100, 110 may be attached to the right door 60 or the left door 70 to allow use of the exercise units 100, 110 with the exercise resistance source 30. To vary the intensity of the workout or the type of workout the cable guide 81 may be adjusted about one if the degrees of freedom or by pivoting the right door 60 or the left door 70 from the first open position to the second open position.

The type of workout may also be varied by utilizing the platform 50. The platform 50 may be pivoted from the storage position to the use position. Once in the use position the platform 50 seat 51 and support 52 may be adjusted to accommodate different exercises or intensity levels. Again the type of exercise unit 100, 110 or the position of the cable guide 81 attached to the right door 60 or the left door 70 may be adjusted along one of the degrees of freedom to vary the work out. The right door 60 or the left door 70 may also be pivoted between the first open position and the second open position to vary the workout.

Upon completion of a workout using the exercise apparatus 10 the platform 50 may be pivoted back into the stored position and the right door 60 and the left door 70 pivoted into the closed position and latched. The working parts of the exercise apparatus 10 are then concealed behind the right door 60 and left door 70 enhancing aesthetic appeal and space efficiency.

We claim:

1. A freestanding exercise apparatus, comprising:

(a) a frame defining a sagittal plane dividing the frame into a left half and a right half with anterior and posterior ends;

(b) a right door pivotally attached to the right half of the frame proximate the anterior end of the frame for pivoting about a right pivot axis;

(c) a left door pivotally attached to the left half of the frame proximate the anterior end of the frame for pivoting about a left pivot axis; and (d) an exercise resistance source connected to the frame;

(e) wherein the frame, right pivot axis, and left pivot axis are configured and arranged such that the angle formed at the intersection of a first plane defined by the right pivot axis and the posterior end of the right half of the frame and a second plane defined by a left pivot axis and the posterior end of the left half of the frame is less than 90°.

2. The freestanding exercise apparatus, as recited in claim 1, further comprising a platform pivotably attached to the frame.

3. The freestanding exercise apparatus, as recited in claim 2, wherein (i) the platform pivots from a stored position to a use position and (ii) the platform is pivotally attached to a bottom member of the frame.

4. The freestanding exercise apparatus, as recited in claim 2, wherein (i) the platform pivots from a stored position to a use position and (ii) the platform is pivotally attached to a top member of the frame.

5. The freestanding exercise apparatus, as recited in claim 1, wherein the exercise resistance source is a weight stack.

6. The freestanding exercise apparatus, as recited in claim 1, wherein the angle is greater than 50°.

7. The freestanding exercise apparatus, as recited in claim 1, wherein the angle is less than 80°.

8. The freestanding exercise apparatus, as recited in claim 1, wherein the right door and the left door may be pivoted from a closed position to a first open position and locked and a second open position and locked.

9. The freestanding exercise apparatus, as recited in claim 1, wherein the right door includes an exercise unit attached to the right door wherein the unit (i) reciprocates along a path relative to the right door, (ii) is configured and arranged to pivot with the right door relative to the frame, and (iii) is operably connected to the exercise resistance source wherein the source provides resistance to the reciprocating exercise unit.

10. The freestanding exercise apparatus, as recited in claim 1, wherein the left door includes an exercise unit attached to the left door wherein the unit (i) reciprocates along a path relative to the left door, (ii) is configured and arranged to pivot with the left door relative to the frame, and (iii) is operably connected to the exercise resistance source wherein the source provides resistance to the reciprocating exercise unit.

11. The freestanding exercise apparatus, as recited in claim 1, wherein the right door has a frame and an outer housing wherein the housing is curved so as to define a space between the housing and the frame.

12. The freestanding exercise apparatus, as recited in claim 1, wherein the left door has a frame and an outer housing wherein the housing is configured and arranged so as to define a space between the housing and the frame.

13. A freestanding exercise apparatus, comprising:

(a) a frame;

(b) an exercise resistance source connected to the frame;

(c) a right door pivotably attached to the frame;

(d) a left door pivotably attached to the frame;

(e) a first exercise unit attached to the right door wherein the unit (i) reciprocates along a path relative to the right door, (ii) is configured and arranged to pivot with the right door relative to the frame, and (iii) is operably connected to the exercise resistance source wherein the source provides resistance to the reciprocating exercise unit; and (f) a second exercise unit attached to the left door wherein the unit (i) reciprocates along a path relative to the left door, (ii) is configured and arranged to pivot with the left door relative to the frame, and (iii) is operably connected to the exercise resistance source wherein the source provides resistance to the reciprocating exercise unit.

14. The freestanding exercise apparatus, as recited in claim 13, wherein the exercise resistance source is a weight stack.

15. The freestanding exercise apparatus, as recited in claim 13, wherein the first exercise unit is attached to the right door via a mechanism and adjustable in two degrees of freedom relative to the door.

16. The freestanding exercise apparatus, as recited in claim 13, wherein the second exercise unit is attached to the left door via a mechanism and adjustable in two degrees of freedom relative to the door.

17. The freestanding exercise apparatus, as recited in claim 13, wherein the first exercise unit is attached to the right door via a mechanism and adjustable in one degree of freedom relative to the door.

18. The freestanding exercise apparatus, as recited in claim 13, wherein the left exercise unit is attached to the door via a mechanism and adjustable in one degree of freedom relative to the door.

19. The freestanding exercise apparatus, as recited in claim 13, wherein the right door and the left door may be pivoted from a closed position to a first open position and locked and a second open position and locked.

* * * * *